US008613440B2

(12) United States Patent
Doan et al.

(10) Patent No.: US 8,613,440 B2
(45) Date of Patent: Dec. 24, 2013

(54) AUTOMATIC DOCUMENT FEEDER

(75) Inventors: Long C Doan, San Diego, CA (US); Thaddie Natalaray, Singapore (SG); Kyi Thu Maung, Singapore (SG); Jeffrey C Madsen, Eagle, ID (US); Jim Albritton-Mcdonald, Windsor, CO (US); Jeoffrey Goh, Singapore (SG); Hin Peng Teoh, Singapore (SG); Curtis J Behrend, San Diego, CA (US); Keng Leong Ng, Singapore (SG)

(73) Assignee: Hewlett-Packard Development Company, L.P., Houston, TX (US)

( * ) Notice: Subject to any disclaimer, the term of this patent is extended or adjusted under 35 U.S.C. 154(b) by 14 days.

(21) Appl. No.: 13/179,995

(22) Filed: Jul. 11, 2011

(65) Prior Publication Data

US 2013/0015621 A1 Jan. 17, 2013

(51) Int. Cl.
*B65H 29/00* (2006.01)

(52) U.S. Cl.
USPC ..... 271/186; 399/374

(58) Field of Classification Search
USPC ..... 271/117, 118, 114, 3.14, 3.19, 291, 271/301, 186; 399/374
See application file for complete search history.

(56) References Cited

U.S. PATENT DOCUMENTS

| | | | | |
|---|---|---|---|---|
| 6,038,424 | A * | 3/2000 | Nakagawa | 399/367 |
| 7,777,920 | B2 * | 8/2010 | Shoda et al. | 358/474 |
| 7,869,755 | B2 * | 1/2011 | Sano et al. | 399/367 |
| 8,210,515 | B2 * | 7/2012 | Nishizawa et al. | 271/3.14 |
| 2002/0008347 | A1 * | 1/2002 | Takida et al. | 271/3.14 |
| 2002/0030321 | A1 * | 3/2002 | Sugiyama et al. | 271/226 |
| 2004/0140606 | A1 * | 7/2004 | Kobayashi et al. | 271/4.01 |
| 2010/0109226 | A1 * | 5/2010 | Kitazawa et al. | 271/3.14 |
| 2011/0109038 | A1 * | 5/2011 | Nishizawa et al. | 271/226 |

* cited by examiner

*Primary Examiner* — Kaitlin Joerger

(57) ABSTRACT

An automatic document feeding device including a pick motor coupled with a pick assembly, a deskew motor coupled with a deskew assembly, a sensor assembly coupled with a main media path and the deskew motor, and a feed motor coupled with a feed assembly. The deskew motor drives the deskew assembly, the deskew assembly deskewing the media sheet and moving the media sheet from the pick assembly to the feed assembly, the deskew assembly moving independently of the pick assembly and the feed assembly. The sensor assembly includes a plurality of sensors. The sensor assembly senses the media sheet moving along the main media path and sends at least one signal to a computer. The computer, based on the at least one signal, sends, an activation signal to at least one of the pick, deskew and feed motors and the first scanner.

20 Claims, 10 Drawing Sheets

AUTOMATIC DOCUMENT FEEDER

BACKGROUND

Many multifunction printers, copying machines and standalone scanners are provided with an automatic document feeder (ADF) for automatically transporting individual sheets from a stack of media sheets to an image reading region, and then ejecting and restacking the sheets automatically onto an output tray. Maximizing the throughput performance of an ADF is important.

The drawings referred to in this description should not be understood as being drawn to scale unless specifically noted.

DESCRIPTION OF EMBODIMENTS

Reference will now be made in detail to embodiments of the present technology, examples of which are illustrated in the accompanying drawings. While the technology will be described in conjunction with various embodiment(s), it will be understood that they are not intended to limit the present technology to these embodiments. On the contrary, the present technology is intended to cover alternatives, modifications and equivalents, which may be included within the spirit and scope of the various embodiments as defined by the appended claims.

Furthermore, in the following detailed description, numerous specific details are set forth in order to provide a thorough understanding of the present technology. However, the present technology may be practiced without these specific details. In other instances, well known methods, procedures, components, and circuits have not been described in detail as not to unnecessarily obscure aspects of the present embodiments.

Unless specifically stated otherwise as apparent from the following discussions, it is appreciated that throughout the present detailed description, discussions utilizing terms such as "sensing", "activating", "identifying", "performing", "receiving", "communicating", or the like, refer to the actions and processes of a computer system, or similar electronic computing device. The computer system or similar electronic computing device manipulates and transforms data represented as physical (electronic) quantities within the computer system's registers and memories into other data similarly represented as physical quantities within the computer system memories or registers or other such information storage, transmission, or display devices. The present technology is also well suited to the use of other computer systems such as, for example, optical computers.

The discussion will begin with a brief overview of the operation of existing ADFs. The discussion will then focus on embodiments of the present technology that provide a system for increasing the throughput of media through an ADF. Embodiments of the present technology utilize three independent motors driving three separate gear assemblies, thereby guiding one or more media sheets through the ADF device.

Overview

In existing ADFs, an optical image reader is typically arranged at the image reading position to read (i.e. scan) the image on one side of the media sheet. Conventional ADFs have a double-sided ("duplex") mode wherein images on both sides of a sheet are scanned by the image reader. In the double-sided mode, after the image on one side of a sheet is scanned by the image reader, the sheet is partially discharged, and then the same sheet is re-routed back through the ADF so that the image on the opposite side of the sheet can be scanned.

Figure 1:
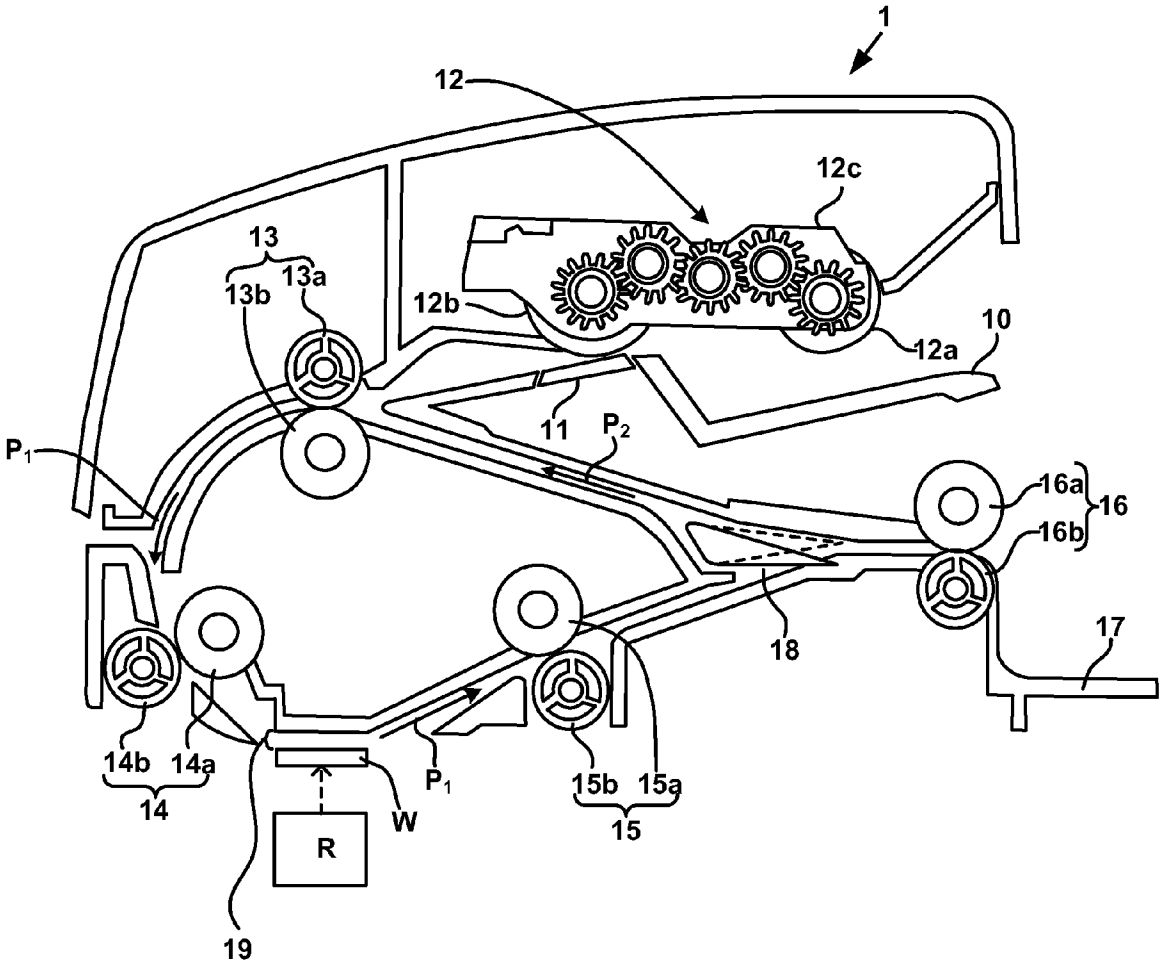
FIG. 1 is a schematic sectional view showing an automatic document feeder.

With reference now to FIG. 1, a schematic sectional view shows an automatic document feeder, the basic internal functioning of an automatic document feeder may be explained. FIG. 1 shows an automatic document feeder 1 (herein after referred to as "ADF 1") equipped with an image reader R according to one embodiment. The ADF 1 includes a sheet supply tray 10 for holding a stack of media sheets (hereinafter, simply referred to as "media stack"), a pick assembly 12, at least one pair of opposing de-skew rollers 13, at least one pair of opposing pre-scan rollers 14, at least one pair of opposing post-scan rollers 15, at least one pair of opposing output rollers 16, and an output tray 17.

The ADF 1 includes a substantially U-shaped, main media path $P_1$ for guiding the media sheet from the pick assembly 12 to the output tray 17. An optical window is arranged along the media path $P_1$ between the at least one pair of opposing pre-scan rollers 14 and the at least one pair of opposing post scan rollers 15. The image data on one side of the media sheet can be read through the optical window W by a conventional image reader R, e.g. an optical scanner, which is arranged on one side the optical window W. As such, the region above the optical window W defines a first scanning region 19 of the ADF 1. The pick assembly 12 includes a pick roller 12*a* and a feed roller 12*b*, which are supported in a housing 12*c*. The pick assembly 12 is configured to pull (i.e., "pick") the uppermost sheet from the media stack and transport the uppermost sheet toward the at least one pair of opposing de-skew rollers 13.

A stationary pad 11 is provided under the feed roller 12*b* in order to allow only the uppermost sheet to pass. Although it is not apparent from the cross-sectional view shown in FIG. 1, the at least one pair of opposing de-skew rollers 13 includes a plurality of upper pinch rollers 13*a* cooperating with a plurality of lower de-skew rollers 13*b* to form a pinch there between. The de-skew rollers 13 are operable to perform skew correction of the separated sheet and to advance the same sheet along the media path $P_1$ toward the at least one pair of opposing pre-scan rollers 14.

The at least one pair of opposing pre-scan rollers 14 are designed to advance the media sheet further downstream toward the first scanning region 19 where the optical window W is located. The at least one pair of opposing post-scan rollers 15 are configured to advance the media sheet from the image reading position toward the at least one pair of opposing output rollers 16. The at least on pair of opposing pre-scan rollers 14 includes a plurality of upper pre-scan rollers 14*a* cooperating with a plurality of lower idler rollers 14*b*. Similarly, the at least one pair of opposing post-scan rollers 15 includes a plurality of upper post-scan rollers 15*a* cooperating with a plurality of lower idler rollers 15*b*. The at least one pair of opposing output rollers 16 are configured to discharge to the output tray 17 the media sheet after scanning occurs. The at least one pair of opposing output rollers 16 includes a pair of upper output rollers 16*a* cooperating with a pair of lower output rollers 16*b*.

The ADF 1 also includes a switch-back path $P_2$ that extends from the at least one pair of opposing output rollers 16 to the at least one pair of opposing de-skew rollers 13. A switching lever 18 is positioned at a junction between the main media path $P_1$ and the switch-back path $P_2$ to guide the direction of the sheet. The switching lever 18 is normally at a "down" position that blocks the sheet passage from the at least one pair of opposing post-scan rollers 15 to the output tray 17, unless the leading edge of a sheet being discharged pushes it upward to allow the sheet to pass. When the switching lever 18 is at the "down" position, the sheet can be guided into the switch-back path $P_2$.

Figure 2:
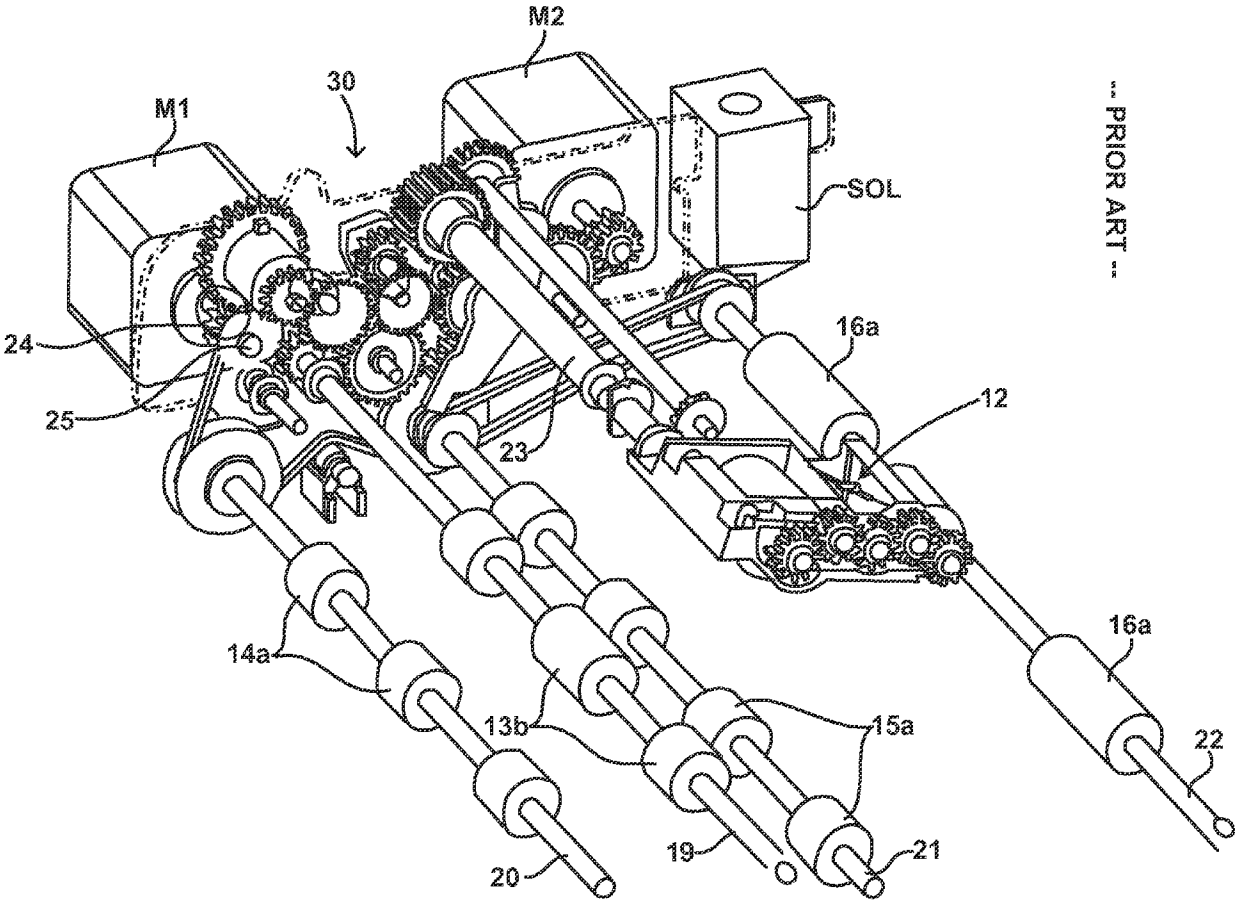
FIG. 2 is an isometric view of a drive system for the automatic document feeder of FIG. 1.

Further, with reference now to FIG. 2, an isometric view of an example drive system for the automatic document feeder of FIG. 1 is shown. In FIG. 2, the lower de-skew rollers 13*b* comprise a series of spaced rollers fixedly mounted on a de-skew shaft 19. The upper pre-scan rollers 14*a* and the upper post-scan rollers 15*a* also comprise a series of spaced rollers fixedly mounted on respective common shafts 20 and 21. The upper output rollers 16*a* are fixedly mounted on a common shaft 22.

The pick assembly 12 is coupled to a cam shaft 23 so as to be pivotable relative to the cam shaft 23. Also shown in FIG. 2 is an embodiment of the drive system for the ADF 1. This drive system includes a media motor M1, a pick motor M2, a solenoid SOL, and a drive transmission 30 associated with the media motor M1 and the pick motor M2.

The media motor M1 is the power source for pivoting the pick assembly 12 downward or upward, and is also the power source for driving pre-scan rollers 14*a*, post-scan rollers 15*a* and upper output rollers 16*a*. The media motor M1 has a motor gear 24, which is mounted on the drive axis 25 of the media motor M1.

The pick motor M2 is the power source for driving the pick assembly 12 so as to perform picking of the uppermost sheet from the media stack. The pick motor M2 is also the power source for driving the lower de-skew rollers 13*b* in order to advance the media sheet toward the pre-scan rollers 14.

The solenoid SOL is operatively connected to the lower output rollers 16*b* such that the lower output rollers 16*b* are caused to move toward from the upper output rollers 16*a* when the solenoid SOL is activated at a predetermined timing. As such, the timing for nipping the upper and lower output rollers (16*a*, 16*b*) can be controlled by the solenoid SOL.

Instead of using solenoids and a pick motor that drive deskew rollers, embodiments of the present technology utilize three independently operating motors to drive corresponding assemblies at independent rates, thereby increasing the throughput of media sheets by an automatic document feeder. More specifically, embodiments of the present technology include a pick, feed and deskew motor as well as a sensor assembly. The pick motor drives the pick assembly to pull a media sheet from a media stack and feed it into a main media pathway through the ADF. The sensor assembly includes a plurality of sensors that are coupled with a computer and at least one of the pick assembly, the deskew assembly, the feed assembly and the first scanner. In general, the sensor assembly senses the media sheet's presence at a predetermined location near each motor and scanner and then sends at least one signal to the computer (as will be described herein). Based on the at least one signal sent to the computer, the computer sends an activation signal to at least one of the motors and scanners, causing the motors to drive associated assemblies and alerting the scanners that a media sheet will arrive shortly and to prepare themselves for scanning.

For example, but not limited to, in one embodiment, the computer sends a signal to the deskew motor, alerting the deskew motor to begin operating because the media sheet is approaching along the main media path. The deskew motor then begins operating, driving the deskew assembly. The deskew assembly consequently deskews the media sheet and moves it from the pick assembly to the feed assembly. Ultimately, the feed motor subsequently drives the feed assembly to feed the media sheet towards a scanning region along the main media path.

Further, embodiments of the present technology enable additional components to be easily added to the ADF, the components of which also serve to further increase the ADF's efficiency. For example, but not limited to, a second scanner may be added along the main media pathway so that both sides of a media sheet may be scanned. Thus, the media sheet need only make one pass (instead of three) through the ADF before it reaches the output tray.

Thus, by enabling the pick, deskew and feed assemblies (as well as the pick, deskew and feed motors) to operate independently of each other and in parallel with each other, as well as at different rates, embodiments of the present technology provide for more efficient pulling (picking), deskewing, feeding and scanning of media sheets, thereby saving time and thus resources. Moreover, since the pick, deskew and feed motors are direct current operating motors, they are quieter than the stepper motor and solenoid of conventional ADFs.

The following discussion will begin with a description of the structure of the components of the present technology. The discussion will then be followed by a description of the components in operation.

Structure

Figure 3:
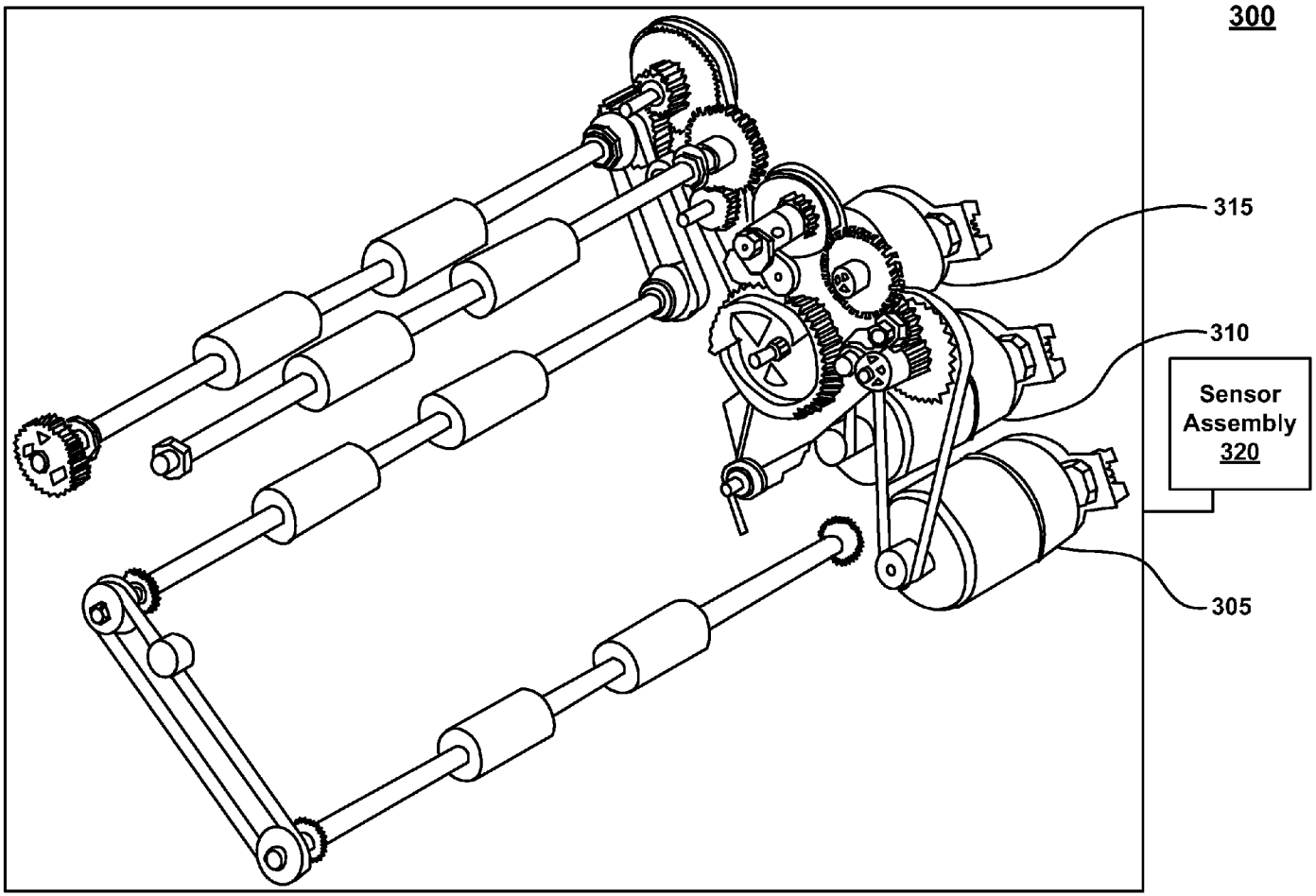
FIG. 3 is a block diagram of a schematic sectional view showing an automatic document feeder, according to an embodiment of the present technology.
Figure 4A:
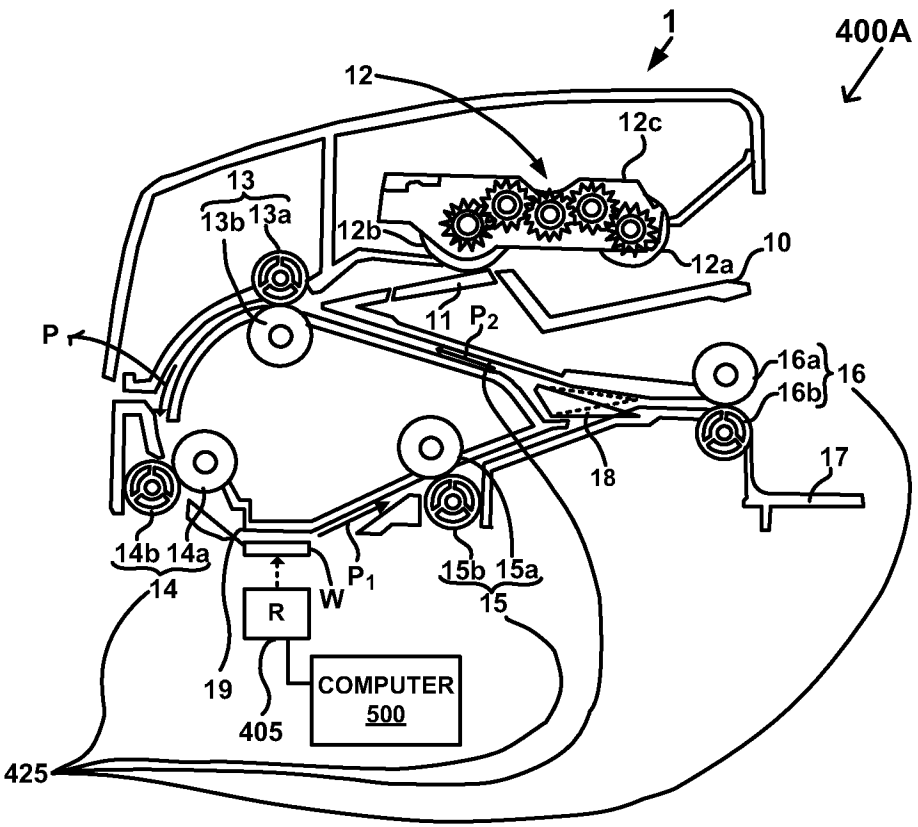
FIG. 4A is a schematic sectional view showing an automatic document feeder, according to an embodiment of the present technology.
Figure 4B:
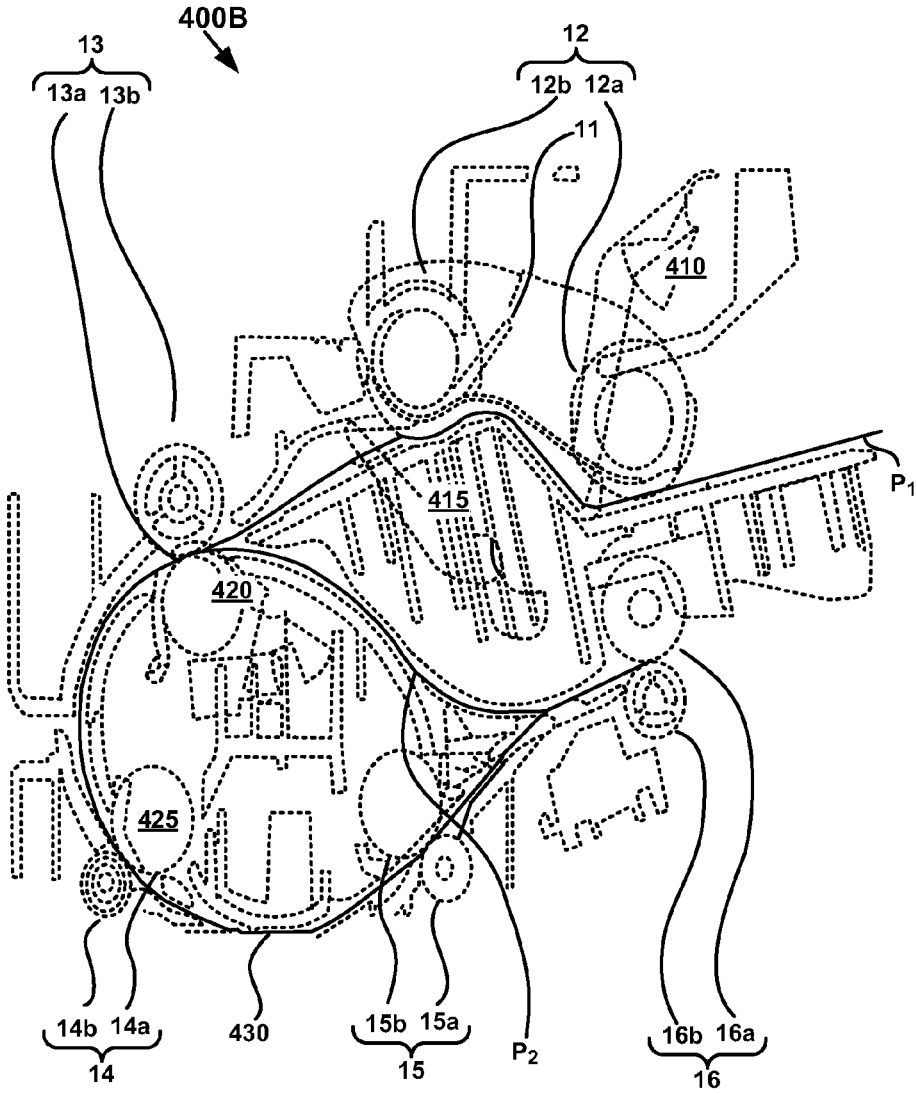
FIG. 4B is a schematic sectional view showing an automatic document feeder, according to an embodiment of the present technology.
Figure 4C:
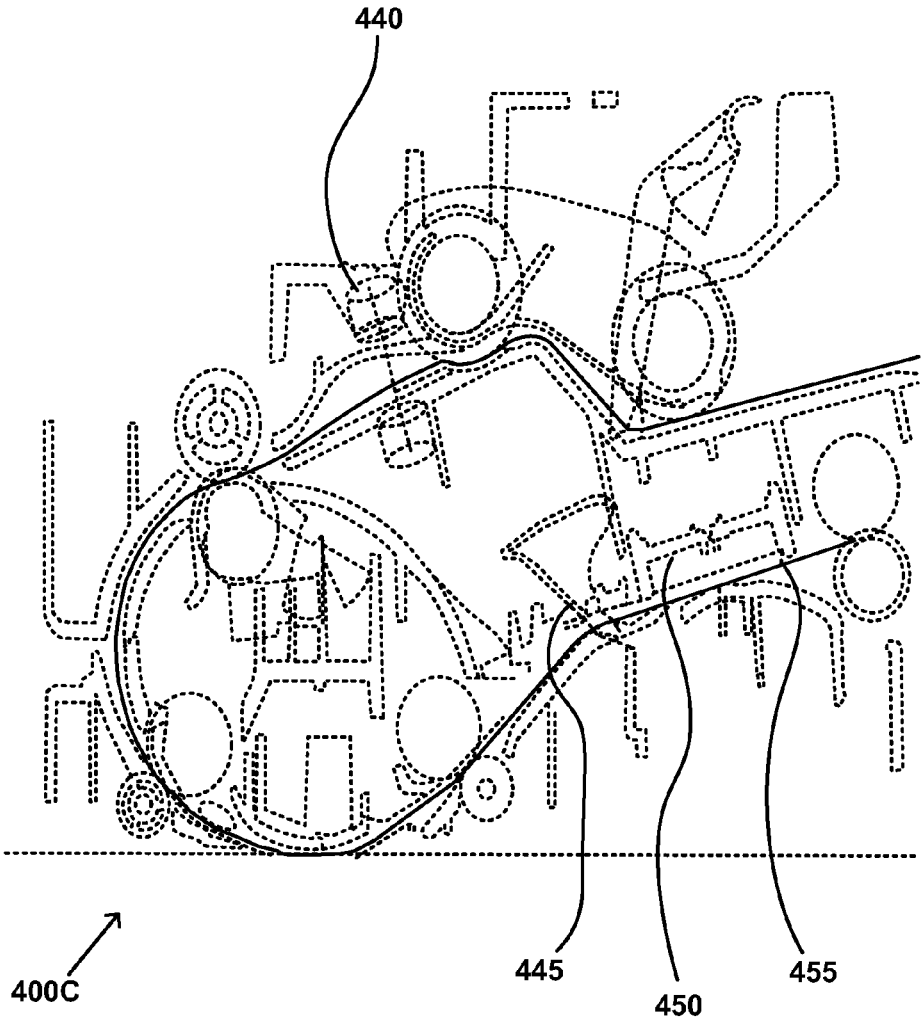
FIG. 4C is a schematic sectional view showing an automatic document feeder, according to an embodiment of the present technology.

FIG. 3 is a schematic sectional view showing components within automatic document feeder 300, according to an embodiment of the present technology. FIGS. 4A-4C are schematic sectional views showing an automatic document feeder, in accordance with an embodiment of the present technology. It should be appreciated that the arrangement of the components shown in FIGS. 4A-4C are examples only and are being used for ease of describing the operation of an ADF. Embodiments of the present technology may include more or less components than those shown in FIGS. 4A-4C, other than the pick motor 305, feed motor 315, sensor assembly 320 and the deskew motor 310 and may have a different arrangement. For example but not limited to, there may be more or less pick 12, deskew 13, feed 14 and output rollers 16.

Further, FIG. 4A shows a three pass single scanner system 400A is shown, in accordance with an embodiment of the present technology, while noting the feed assembly 425. FIG. 4B also shows a three pass single scanner system 400B, in accordance with an embodiment of the present technology, while noting various rollers and sensors. FIG. 4C shows a single pass two sided scan system 400C, in accordance with an embodiment of the present technology.

Embodiments of the present technology include a pick motor 305, a feed motor 315, a sensor assembly 320 and a deskew motor 310. In one embodiment, the pick motor 305 is coupled with a pick assembly 12. The pick assembly 12 includes a first and second pick roller, 12*a* and 12*b*, respectively. The pick motor 305 drives the pick assembly 12, whereas the pick assembly 12 pulls a media sheet from a media stack one by one and feeds the media sheet into a main media path $P_1$. The main media path $P_1$ guides the media sheet from the pick assembly to a first scanning region 19 and from the first scanning region 19, ultimately to an output tray 17. The first scanning region 19 is coupled with a first scanner 405 positioned for scanning an image of a first side of the media sheet as it passes through the first scanning region 19. While described later, the first scanning region 19 is that region within which a media sheet is scanned. Of note, the first scanner 405 of FIG. 4A is not positioned internal to the ADF, but rather lies underneath the flatbed glass.

In one embodiment, the pick assembly 12 includes a stationary pad 11 configured for ensuring that more than one media sheet does not enter the main media path $P_1$ at the same time. The stationary pad 11 further increases the ADF's ability to reduce hand-off error occurring from the release of the pick assembly 12.

In one embodiment, the deskew motor 310 is coupled with a deskew assembly. The deskew motor 310 drives the deskew assembly. It should be appreciated that the deskew assembly includes the at least one pair of opposing deskew rollers 13. The deskew assembly deskews the media sheet and moves the media sheet from the pick assembly 12 to the feed assembly 425. For example, the deskew assembly squares the leading edge of a media sheet. The squared media sheet is then delivered to the feed assembly 425 (e.g., the at least one pair of opposing pre-scan rollers 14, as will be described). The deskew assembly moves independently of the pick assembly and the feed assembly 425.

In another embodiment, the feed motor 315 is coupled with the feed assembly 425. The feed motor 315 drives the feed assembly 425. The feed assembly 425 feeds the media sheet towards the first scanning region 19 along the main media path $P_1$.

The feed assembly 425, in one embodiment, includes at least one pair of opposing pre-scan rollers 14, at least one pair of opposing post-scan rollers 15 and at least one pair of opposing output rollers 16 and a switch-back path $P_2$.

The at least one pair of opposing pre-scan rollers 14 are positioned along the main media path $P_1$ after the deskew assembly and before the first scanning region 19. The at least one pair of opposing post-scan rollers 15 are positioned along the main media path $P_1$ after the first scanning region 19. Further, the at least one pair of opposing output rollers 16 are positioned along the main media path $P_1$ after the at least one pair of opposing post-scan rollers 15 and before the output tray 17. In one embodiment, the at least one pair of opposing pre-scan 14, post-scan 15 and output rollers 16 are configured for advancing the media sheet in a forward direction toward the output tray 17 while the first side of the media sheet is scanned during a first pass of the first scanner 405. In another embodiment, the at least one pair of opposing pre-scan 14, post-scan 15 and output rollers 16 are configured for advancing the media sheet in a reverse direction away from the output tray 17, after the first side of the media sheet is scanned during the first pass under the first scanner 405.

The switch-back path $P_2$ extends from the at least one pair of output rollers 16 toward the deskew assembly. The switch-back path $P_2$ receives the media sheet driven in reverse by the at least one pair of opposing output rollers 16 such that the media sheet is then turned around. The media sheet is further driven in reverse, away from the output tray 17 and towards the at least one pair of opposing pre-scan rollers 14. The second side of the media sheet that is driven in such reverse direction, is then able to be scanned in a second pass through the first scanning region 19. Whereupon, after this second pass through the first scanning region 19 while moving towards the at least one pair of opposing pre-scan rollers 14, the media sheet is once again advancing in a forward direction toward the output tray 17, for a "third pass".

During this third pass, the media sheet once again travels past the post-scan rollers along the main media path $P_1$, and then travels along the switch back path $P_2$, to turn around once again. This second "turn around" of the media sheet is necessary in order that the media sheet remains in the same orientation and placement as its position within the original media stack before the media sheet was fed into the ADF for copying. Of note, in one embodiment, during the third pass, since the media sheet is not being scanned, the media sheet is not deskewed. Thus, in one embodiment, during the third pass, the deskewing function, that of squaring (or in this case re-squaring) the leading edge of the media sheet does not occur. In other words, during the third pass, the deskewing function becomes dormant for the entirety of just the third pass. The media sheet merely passes through the deskew assembly and the feed assembly 425 towards the output tray 17. In fact, the computer 500 may optionally send a signal to individual motors or a signal to the collective group of motors to change their speed at which the individual motors are operating. For example, the signal may direct the individual motors to speed up their functioning during the third pass. In this regards, the travel time of the media sheet through the ADF machine then would be less during the third pass compared to the first and/or the second pass.

Significantly, in embodiments of the present technology, the pick motor 305 moves independently of the deskew 310 and feed motors 315. Due to the number of independent motors in embodiments of the present technology, the inter-page gap between being picked and being fed to the scanning region 19 is reduced. In other words, the deskew motor 310 picks up the slack occurring between the driven pick assembly 12 and the driven feed assembly 425, by driving the media sheet along the main media path $P_1$ at an accelerated rate, thereby reducing the time gap occurring between media sheets being scanned.

For example, and as explained herein, during the third pass of a media sheet in a three pass single scanner system, the assemblies may be driven faster by the motors. Additionally, during the third pass, the pick motor 305 may drive the pick assembly 12 to pick up a media sheet, in anticipation of running it along the main media path $P_1$. Once picked, the media sheet is then "parked" (not moving) in the pick assembly 12, waiting for the pick motor 305 to begin operation again, wherein the pick motor 305 drives the pick assembly 12 to cause the media sheet to move along the main media path $P_1$. In another embodiment, the "pick and park" function occurs during a first and/or second pass of the media sheet moving along the main media path $P_1$.

Thus, due to independently operating motors and assemblies enabling parallel operation and movement of more than one media sheet along the main media path $P_1$, its "pick and park" ability, as well as the computer 500's ability to determine the location and speed of moving media sheets along the main media path $P_1$, embodiments of the present technology enable a media sheet to move through the ADF machine at a faster rate than conventional ADF machines, thereby increasing throughput. Moreover, due to the deskew assembly, the greater throughput is also of greater quality than that of conventional ADF machines. Furthermore, it should also be appreciated that due to the independently operating motors, not only can the motors be sped up during one of the three passes, but the motors may operate such that they drive the associated assemblies at different speeds, in contrast to the conventional ADFs in which all assemblies operate at the same speed. Thus, embodiments of the present technology with independently operating assemblies activated by the computer 500 (which gathers signals from the sensor assembly 320) provide for more optimization design choices.

In one embodiment, the sensor assembly 320 is coupled with the main media path $P_1$. The sensor assembly 320 includes a plurality of sensors. Each sensor of the plurality of sensors is coupled with at least one of the pick assembly 12, the deskew assembly, the feed assembly 425, the first scanner 405 and the second scanner 450 (as will be discussed later and is shown in FIG. 4C) and a computer 500. The computer 500 receives the signals sent from each sensor of the sensor assembly 320. The computer 500 processes these signals to determine at least the location and speed of the media sheets moving along the main media path $P_1$. Based on the determined location and speed of the media sheets, the computer 500 sends an activation signal to at least one of the pick motor 305, the deskew motor 310, the feed motor 315 and the first scanner 405. The activation signal informs the various motors when and how fast to operate its associated assemblies. The activation signal alerts the first scanner 405 that a media sheet is about to arrive.

Thus, as explained herein, since the various motors are able to operate independently, the associated assemblies also are able to operate independently. Therefore, the various assemblies are able to speed up and slow down the movement of a media sheet along the main media path $P_1$, in order to at least either reduce the inter-page gap or increase the speed of the media sheet during certain passes (e.g., third pass). Further, and significantly, the ability of the pick assembly 12 (and more particularly, the first pick roller 12*a*) to pick and/or attempt to pick a media sheet from the media stack and then wait with that media sheet until the media sheet may be fed further along the main media path $P_1$ is important. In many cases, it takes several tries to "pick" just one media sheet. Since, the pick assembly 12 attempts to pick (and in many cases successfully picks) a next media sheet during the same time that the rest of the ADF is busy moving the previously picked media sheet along the main media path $P_1$, when the ADF system is ready to move the next media sheet, it is already poised and ready to be moved, thus saving pick time. Consequently, embodiments of the present technology enable a more efficient ADF system with greater throughput than conventional ADFs.

It is significant to note that since the computer 500 receives the signals from all of the sensors of the sensor assembly 320, the computer 500 is able to track the media sheets as they move along the main media path P1. The computer 500 is able to make intelligent decisions as to when, where, and how fast a media sheet should move along the main media path P1, based on the information received from the sensors of the sensor assembly 320.

Referring specifically to FIGS. 3, 4A and 4B, a description of the sensor assembly 320 operating along with the pick motor 305, the deskew motor 310 and the feed motor 315, will be described. In the three pass single scanner system 400B, the following description traces the movement of a media sheet through the system 400B along the main media path $P_1$. The system 400B in FIG. 4B includes a paper presence sensor 410, a pick motor 305 (from FIG. 3), a pick assembly 12, a stationary pad 11, a pick success sensor 415, a deskew motor 310 (from FIG. 3), a deskew sensor 420, at least one pair of opposing deskew rollers 13, a feed motor 315 (from FIG. 3) a pre-scan sensor 425, at least one pair of opposing pre-scan rollers 14, a scan line 430, at least one pair of opposing post-scan rollers 15 and at least one pair of opposing exit rollers 16.

The paper presence sensor 410, the pick success sensor 415, the deskew sensor 420 and the pre-scan sensor 425 comprise the sensor assembly 320, according to one embodiment of the present technology. It should be appreciated that the sensor assembly 320 may have more or less sensors than the ones noted herein.

In one embodiment, the paper presence sensor 410 and the pick success sensor 415 are coupled with the pick assembly 12 and the computer 500. The deskew sensor 420 is coupled with the deskew assembly and the computer 500. The pre-scan sensor 425 is coupled with the feed assembly 425 and the computer 500. Each sensor of the sensor assembly 320 alerts the computer 500 that the media sheet moving along the main media path $P_1$ is within a predetermined distance from the assemblies associated with the motor.

For example, but not limited to, once the media sheet within a media stack is determined to be "present" by being positioned at a predetermined location along the main media path $P_1$, the paper presence sensor 410 sends a signal to the computer 500. The signal signifies to the computer 500 that the media sheet is at a predetermined distance away from/to the first and second pick rollers 12*a* and 12*b*, respectively of the pick assembly 12. The computer 500, based on this information and information from other sensors, sends an activation signal to the pick motor 305, signifying that it should begin the operation of picking up a media sheet. Once operation has begun, the pick motor 305 drives the pick assembly 12, and thereby the first and second pick rollers 12*a* and 12*b*, respectively, to pick the media sheet from the media stack and cause it to travel along the main media path $P_1$ towards the deskew assembly. Further, the activation signal sent to the pick motor 305 also includes a direction regarding the speed at which the pick motor 305 should operate.

Further, in one embodiment, the pick success sensor 415 sends a signal to the computer 500 when it is determined that a media sheet has passed the second pick roller 12*b*. The computer 500, based on the signal sent to the computer 500 by the pick success sensor 415 and other information sent from other sensors, sends an activation signal to the deskew motor 310, causing the deskew motor 310 to begin driving the at least one pair of opposing deskew rollers 13 of the deskew assembly to perform deskewing, described herein. The pick success sensor 415 may also send a signal to the computer 500 if it is determined that a media sheet has not passed the second pick roller 12*b*. In another embodiment, the pick success sensor 415 does not send a signal, regardless of determining that a media sheet has not passed the second pick roller 12*b*.

In the case in which a media sheet is detected by the pick success sensor 415 to have passed the second pick roller 12*b*, the computer 500 will determine the distance from the leading edge of the media sheet to the at least one pair of opposing deskew rollers 13 depending on the pick and scan speed determined and send the signal to activate the deskew algorithm for the at least one pair of opposing deskew rollers 13 and first and second pick rollers, 12*a* and 12*b*, respectively, to be driven.

In one embodiment, in the case in which the media sheet is not detected by the pick success sensor 415, then the computer 500 sends a signal to the pick rollers to do a pick re-try algorithm for two more times. During these re-tries, the pick assembly 12 will move up and down trying to move the top media sheet to pass the pick success sensor 415. After these two re-tries, if it still does not detect a media sheet having passed the second pick roller 12*b*, then the computer 500 sends the signal to all the motors to cease operation and sends the signal to the user interface (control panel) to request a re-stacking of the input stack. It should be appreciated that while in one embodiment, two re-tries are attempted, other embodiments may include more or less re-try attempts.

In one embodiment, the computer 500 sends signals to the pick motor 305, deskew motor 310 and the feed motor 315 for cessation of operations in the situation in which a media sheet is not detected and two re-tries have been attempted and failed, as described above.

In one embodiment, the deskew sensor 420 sends a signal to the computer 500 when the deskew sensor 420 determines that the media sheet moving along the main media path $P_1$ reaches a predetermined location or a predetermined distance away from the deskew sensor 420, the at least one pair of opposing deskew rollers 13, or both. It should be noted that, as will be described herein, the deskew motor 310 is associated with at least three functions: 1) deskewing the media sheet; 2) driving the deskew assembly to activate the first (or second 530) selectable background assembly 525; and 3) opening and closing (nipping) the at least one pair of opposing output rollers 16. However, it should be appreciated that the opening and closing of the opposing output rollers 16 is a non-dedicated function. In other words, the nipping may be performed by a free motor (a motor operating independently of another motor). Thus, in one embodiment, the opening and closing of the at least one pair of opposing output rollers 16 is driven by the pick motor 305, instead of the deskew motor 310.

In one embodiment, the pre-scan sensor 425 sends a signal to the computer 500 when the pre-scan sensor 425 determines that the media sheet moving along the main media path $P_1$ reaches a predetermined location or a predetermined distance away from the pre-scan sensor 425, the at least one pair of opposing pre-scan rollers 14, or both. As stated herein, the feed assembly 425 includes the at least one pair of opposing pre-scan rollers 14, the at least one pair of opposing post-scan rollers 15 and the at least one pair of opposing output rollers 16. The rollers 14, 15 and 16 of the feed assembly operate in tandem and at the same speed, with the same timing. The computer 500, based on the signal sent from the pre-scan sensor 425 and other information sent from other sensors, sends an activation signal to the feed assembly 425 to begin operating, at a certain speed.

Thus, once the media sheet is fed through the at least one pair of opposing pre-scan rollers 14, it continues to move along the main media path $P_1$, over the first scanner 405 within the first scanning region 19, and through the at least one pair of opposing post-scan rollers 15 towards the output tray 17.

However, once the media sheet moves past the at least one pair of opposing post-scan rollers 15, and a portion of the media sheet moves through the at least one pair of the opposing output rollers 16, the feed motor 315 reverses itself, thus reversing the direction of the rollers of the feed assembly. More particularly, the rollers of the feed assembly 425 reverse when the trailing edge of the media sheet comes near to going through the at least one pair of the opposing output rollers 16. Further and of note, the pre-scan sensor 425 coupled with the feed assembly 425 and the computer 500, is able to determine the position of the trailing edge of the media page during its movement along the main media path $P_1$, through the different opposing rollers of the feed assembly 425. Once the pre-scan sensor 425 senses that the trailing edge of the media sheet reaches a predetermined location near the at least one pair of opposing output rollers 16, the computer 500, having received these signals regarding the position of the media sheet from the pre-scan sensor 425, sends an activation signal to the feed motor 315, thereby causing the operation of the feed assembly 425 to be reversed.

Once the feed assembly 425, and hence the feed rollers reverse themselves, the media sheet follows the switch-back path $P_2$ towards the at least one pair of opposing deskew rollers 13, as well as the deskew sensor 415. The deskew sensor 420 senses the presence of the media sheet at a predetermined location, such as buckling at the entrance to the main media path $P_1$ between the at least one pair of opposing deskew rollers 13, and sends a signal to the deskew motor 310 that the deskew motor 310 should resume operation, thereby driving the at least one pair of opposing deskew rollers 13 to pull the media sheet into the main media path $P_1$. The media sheet then continues its movement along the main media path $P_1$ as has been described herein.

Significantly, it can be seen that once the media sheet passes through the at least one pair of opposing post-scan rollers 15, partially enters the at least one pair of opposing output rollers 16, moves backwards along the switch-back path $P_2$, enters the main media path $P_1$ through the at least one pair of opposing deskew rollers 13, and continues along the main media path $P_1$ to then be scanned for a second time by the first scanner 405, the media sheet itself has been turned around such that the other side of the media sheet is the side that is being scanned during the second scan. Of further note, if the media sheet were then to exit the main media path into the output tray 17 at this stage, the resulting media stack would result in media sheets arranged in an order different from that order of the media stack before it entered the ADF.

Furthermore, on the media sheet's second and third pass (described below), the deskew motor 310 drives the at least one pair of opposing output rollers 16 to open and close (nip) very quickly, such that the leading edge and the trailing edge may cross each other. In one embodiment, after the at least one pair of opposing output rollers 16 nip shut, the components of the feedback assembly 425, including the at least one pair of opposing output rollers 16, continue to operate in the forward direction for a short period of time, and then change to operate in the reverse direction, thus moving the media sheet towards the switch-back path $P_2$. However, in another embodiment, after the at least one pair of opposing output rollers 16 nip shut, the components of the feedback assembly 425, including the at least one pair of opposing output rollers 16, continue to operate in the forward direction, and move the media sheet towards the output tray 17.

Moreover, the pre-scan sensor 425 sends a signal to the computer 500 regarding the position of the media sheet along the main media path $P_1$ and within the feed assembly 425 area. Based on this signal from the pre-scan sensor 425 and other signals from sensors within the sensor assembly 320, the computer 500 sends an activation signal to the feed assembly 425, and more particularly, to the at least one pair of opposing output rollers 16, to open up (allowing the trailing edge and the leading edge of the media sheet to cross each other) and then close again. This nipping, driven by, in one embodiment, the deskew motor 310, occurs in only the second and third pass of the three pass single scanner system 400B.

Thus, instead of using a solenoid to drive the nipping of the at least one pair of opposing output rollers 16, embodiments of the present technology utilize an independently operating motor, such as but not limited to, the deskew motor 310, to drive the nipping of the at least one pair of opposing output rollers 16. Additionally, since the nipping of the at least one pair of opposing output rollers 16 is a non-dedicated function, the determination of which motor of an ADF 300 is to include the function of nipping may be decided based on optimizing the objectives for the ADF 300 itself. For example but not limited to such, it may be determined that the deskew motor 310 should be designed to drive the nipping of the at least one pair of opposing output rollers 16, based on, perhaps, a large number of functions already assigned to the deskew motor 310.

Consequently, in regards to the second and third pass, the media sheet moves along the main media path $P_1$ and the switch-back path $P_2$ once more, for a third pass, before the media sheet is released to the output tray 17 to form a resulting media stack. During this third pass, in one embodiment, the operation of the sensor assembly 320 along with the pick motor 305, deskew motor 310 and feed motor 315 and their associated assemblies, is the same as that operation during the second pass. However, in another embodiment, the operation of the sensor assembly 320 along with the pick motor 305, deskew motor 310 and feed motor 315 and their associated assemblies, is different as that operation during the second pass.

For example, and as explained herein, during the third pass, the pick motor 305, the deskew motor 310 and the feed motor 315 may be instructed, through the activation signal, to speed up. This is because it is not necessary that the media sheet be deskewed since the media sheet will not be "scanned" during the third pass. Thus, the movement of the media sheet through the main media path $P_1$ during the third pass may be significantly faster than that movement during the first and the second pass.

As stated herein, the pick motor 305, the deskew motor 310 and the feed motor 315 operate independently, and are capable of operating at different speeds and at different times. The sensors of the sensor assembly 320 are able to sense when the media sheet is approaching its associated rollers and signal to the computer 500, which then activates various motors to begin driving the associated assemblies that move the media sheet along the main media path $P_1$. Further, in one embodiment, since the sensors of the sensor assembly 320 are able to communicate with each other, the sensors are thus able to anticipate when a media sheet is moving near and/or moving into the output tray 17, and to ready its associated assemblies with a second media sheet. Therefore, embodiments of the present technology enable a greater throughput to be realized.

FIG. 4C shows a single pass two sided scan system 400C. Referring specifically to FIGS. 3 and 4A-4C, a description of the sensor assembly 320 operating along with the pick motor 305, the deskew motor 310 and the feed motor 315, will be described. In the single pass two sided scan system 400C, the following description traces the movement of a media sheet through the system 400C along the main media path $P_1$.

As can be seen, the single pass two sided scan system 400C of FIG. 4C has at least the same components of the three pass single scanner system 400B of FIG. 4B, but without the pick success sensor 415 and the switch-back path $P_2$. Additionally, in one embodiment, the single pass two sided scan system 400C includes an ultrasonic multi-feed sensor 440, a second pre-scan sensor 445 and a second scanner 450 that is coupled with a second scanning region 455. The second pre-scan sensor 445 and the second scanner 450 are positioned between the at least one pair of opposing post-scan rollers 15 and the output tray 17.

In one embodiment, the ultrasonic multi-feed sensor 440 senses when more than one media sheet is picked by the pick assembly 12, and sends a signal to the computer 500 of such. The computer 500, based on the signal from the ultrasonic multi-feed sensor 440 as well as signals from other sensors, sends an activation signal to the pick motor 305, the deskew motor 310 and the feed motor 315 to cease operations until the main media path $P_1$ is cleared of the multiple media sheets picked at the same time by the pick assembly 12. The ultrasonic multi-feed sensor 440 also functions to help the computer 500 determine at what speed the motors should be operating, thereby driving the assemblies which move the media sheet along the main media path $P_1$. For example, the ultrasonic multi-feed sensor 440 is able to detect how thick a piece of media sheet is by causing an ultrasonic waveform to be directed at the media sheet Based on this thickness information sent to the computer 500, the computer 500 is able to calculate how fast and/or how close the trailing edge of the media sheet should be approaching the deskew assembly. For example, a thick piece of media sheet will not buckle very much at the at least one pair of opposing deskew rollers 14*a*. Therefore, the computer 500, based on the thickness information, will determine the speed at which the media sheet should approach the deskew assembly, and how close portions of the media sheet to get to the deskew assembly before the deskew motor begins operations.

In one embodiment, after the media sheet passes through the at least one pair of opposing post-scan rollers 15, it then moves forward along the main media path $P_1$ towards the second scanner 450 coupled with a second scanning region 455. Further, in one embodiment, the second pre-scan sensor 445 senses when the media sheet is a certain distance away from itself and/or the second scanner 450. Upon sensing the media sheet at a predetermined distance away, the second pre-scan sensor 445 sends a signal to the computer 500. The computer 500 then sends an activation signal to the second scanner 450, alerting the second scanner 450 that a media sheet is arriving forthwith. Of note, the second scanner 450 resides within the ADF 300. Further, the second scanner 450 is positioned so that the side opposite the side that was scanned by the first scanner 405 is then scanned.

In one embodiment, the scanning region 19 of the ADF device includes a second scanner 410 positioned for scanning an image of a second side of a media sheet such that the first and the second sides of the media sheet are scanned in a single pass through the scanning region 19 before the media sheet is output to the output tray 17.

Thus, embodiments of the present technology also enable components to be added in order to arrive at either a three pass single scanner system 400B or a single pass two sided scan system 400C. Embodiments of the present technology provide for independently operating motors that are able to run at different speeds and times and that are able to monitor the movement of media sheets through the ADF. Thus, for example, if the sensor assembly 320 determines that a media sheet has moved through the main media path $P_1$ such that a large gap is left between the first media sheet and the second media sheet moving along the main media path $P_1$, then the sensor assembly 320 may signal to the computer 500, which in turn activates the appropriate motor to begin/change its operating speed. In one embodiment, the appropriate motor drives its associated assembly at a faster rate in order to catch the second media sheet up with the first, thereby closing the inter-page gap and increasing throughput.

Figure 5:
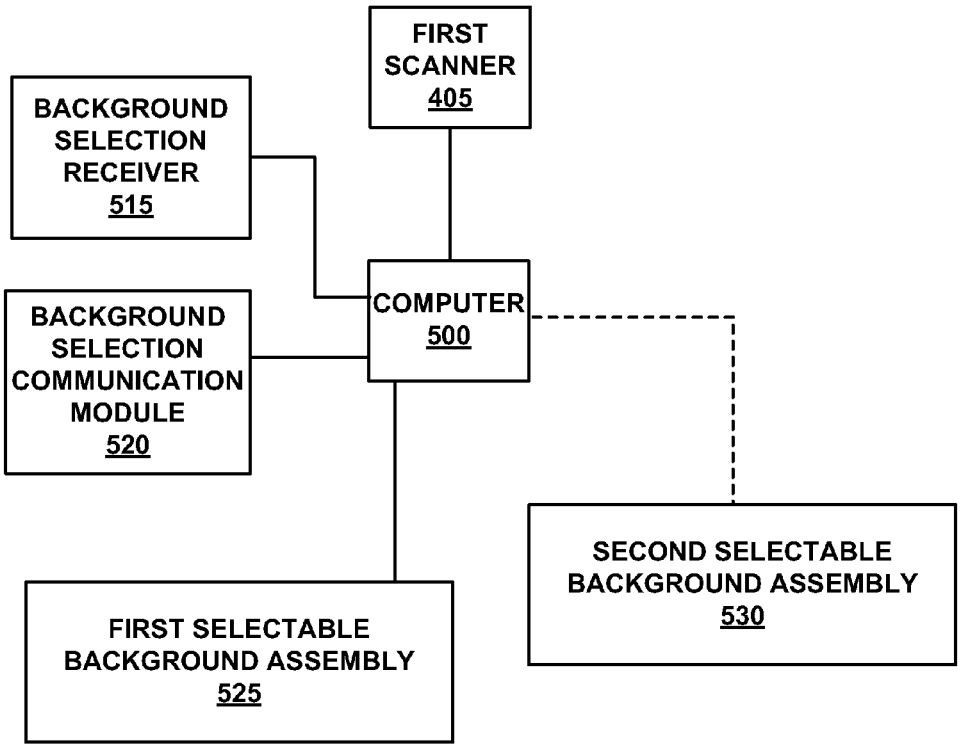
FIG. 5 is a block diagram of components coupled with the computer 500 of FIG. 4A, according to an embodiment of the present technology.

Referring now to FIG. 5, a block diagram of components coupled with the computer 500 of FIG. 4A is shown in accordance with an embodiment of the present technology. In another embodiment, the ADF device includes a computer 500 and a first selectable background assembly 525. Also coupled with the computer 500 are the background selection receiver 515 and the background selection communication module 520. In one embodiment, the background selection receiver 515 receives a selectable background selection. In another embodiment, the background selection communication module 520 communicates the selectable background selection. In one embodiment, the background selection communication module 520 communicates the selectable background selection to the first selectable background assembly 525.

In one embodiment, the first selectable background assembly 525 faces a second side of the media sheet as it passes through said first scanning region 19. The second side is opposite said first side of the media sheet. The first selectable background assembly 525 responds to the selectable background selection by toggling to a position corresponding to a black or white background of the selectable background selection.

In another embodiment, a second selectable background assembly 530 is coupled with the computer 500, as well as the first selectable background assembly 525. The second selectable background assembly 530 faces the first side of the media sheet as it passes through the second scanning region 455. The second selectable background assembly 530 responds to the selectable background selection by toggling to a position corresponding to a black or white background of the selectable background selection.

The first and second selectable background assembly, 525 and 530, respectively, prevent light from leaking through paper, from the front to back or vice versa, thereby causing the back side image of a scanned document from undesirably showing up in the copied image. Most ADF machines use a white background when scanning images. In anticipation of an image "leaking" through a document during scanning, a user may select a black background. The black background prevents the text on the back side of a media sheet from reflecting back to the front side. Thus, the scanner is prevented from seeing the back side of the media sheet.

Once the black background is selected, the computer 500 sends a signal to the deskew motor 310. The deskew motor 310 drives the deskew assembly to activate the first (or second 530) selectable background assembly 525. The first selectable background assembly 525 (or the second selectable background assembly 530) then toggles (e.g., rocks back and forth) to the position such that a black background is provided. This can be seen in FIGS. 4B and 4C. FIG. 4B shows a first selectable background assembly 525 in a first position providing for a black background. However, FIG. 4C shows a second selectable background assembly 530 in a second position, that of a calibration position (e.g., during calibration mode).

Significantly, the first and second selectable background assemblies, 525 and 530, respectively, are coupled with each other. When the first selectable background assembly 525 is in a position providing for a black background, so is the second selectable background assembly 530 in a position providing for a black background. Additionally, the three pass single scanner system 400B only may accommodate a first selectable background assembly 525. However, the single pass two sided scan system 400C may accommodate both a first and second selectable background assembly, 525 and 530, respectively.

Further, only the single pass two sided scanner system 400C has a calibration mode. More particularly, the second scanner 450 has a calibration strip. The second selectable background assembly 530, upon demand (e.g., a receipt of a selection of a white or black background) moves to the calibration strip position so that one or more sensors within the second scanner 450 can calibrate themselves. After the one or more sensors within the second scanner 450 calibrate themselves, the second selectable background assembly 530 toggles to the selected background position. Thus, if a white background has been selected, then the second selectable background assembly 530 toggles to a position that would produce a white background. If a black background has been selected, then the second selectable background assembly 530 toggles to a position that would produce a black background. Significantly, since the second selectable background assembly 530 is only activated on-demand and does not continuously move to a calibration position, the second selectable background assembly 530 is able to avoid inadvertent or unnecessary scratching and contamination as a media sheet passes through the second scanning region 455.

In one embodiment, and of further note, one or more sensors within the first scanner 405 are able to move to a predetermined position and do sensor calibration, such that the one or more sensors do not need to use the first selectable background assembly 525 for calibration, even though the first selectable background assembly 525 could be used for this purpose.

Thus, embodiments of the present technology enable the addition of components to achieve a three pass single scanner system 400B or a single pass two sided scanner system 400C. The independently operated pick motor 305, deskew motor 310 and feed motor 315 enable both the three pass single scanner system 400B and the two sided scanner system 400C to achieve a greater throughput than conventional ADFs, with better quality copies.

Operation

Figure 6A:
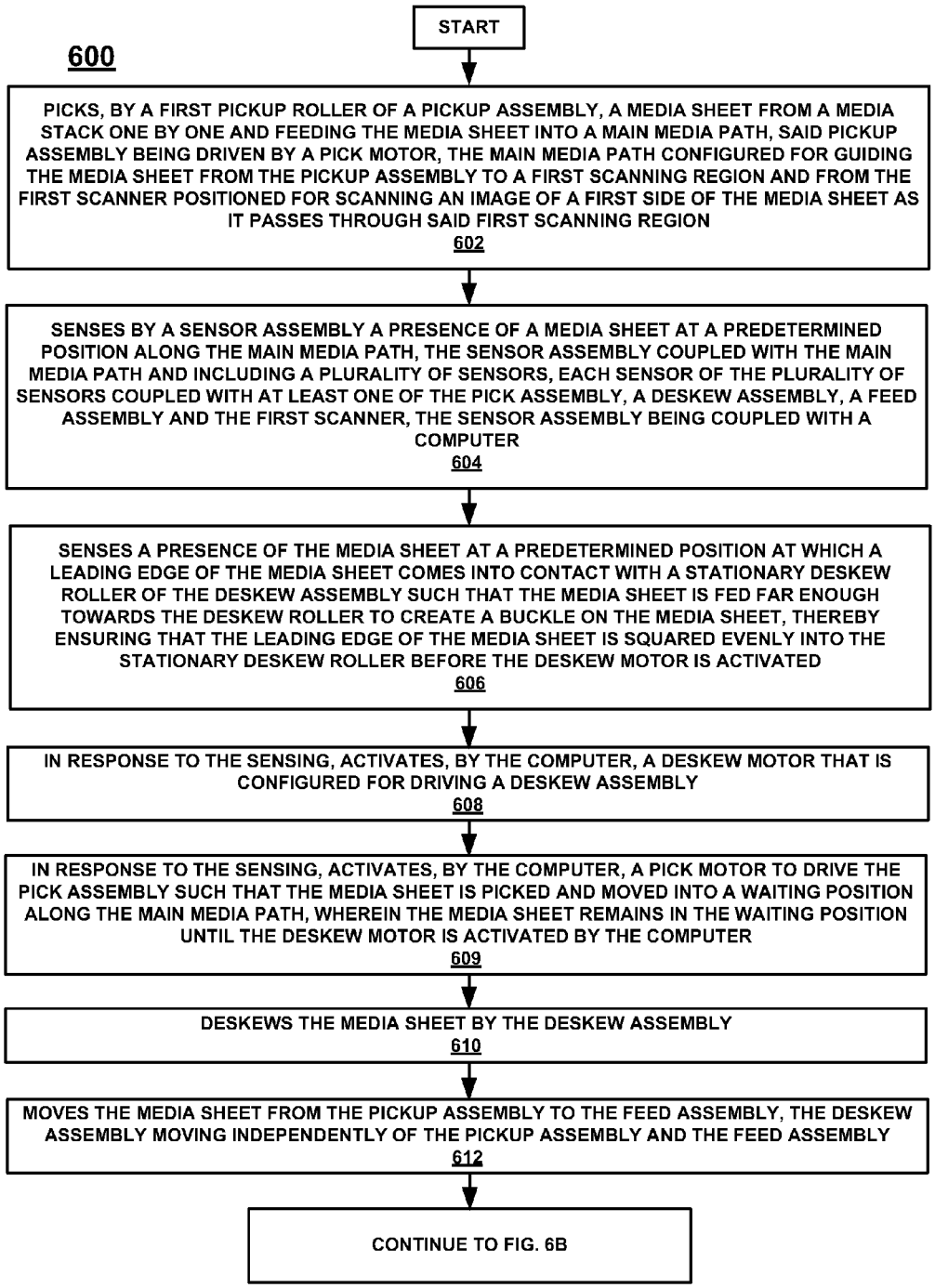
FIG. 6A is a flow diagram of a method for feeding a media sheet through an automatic document feeding device, according to an embodiment of the present technology.
Figure 6B:
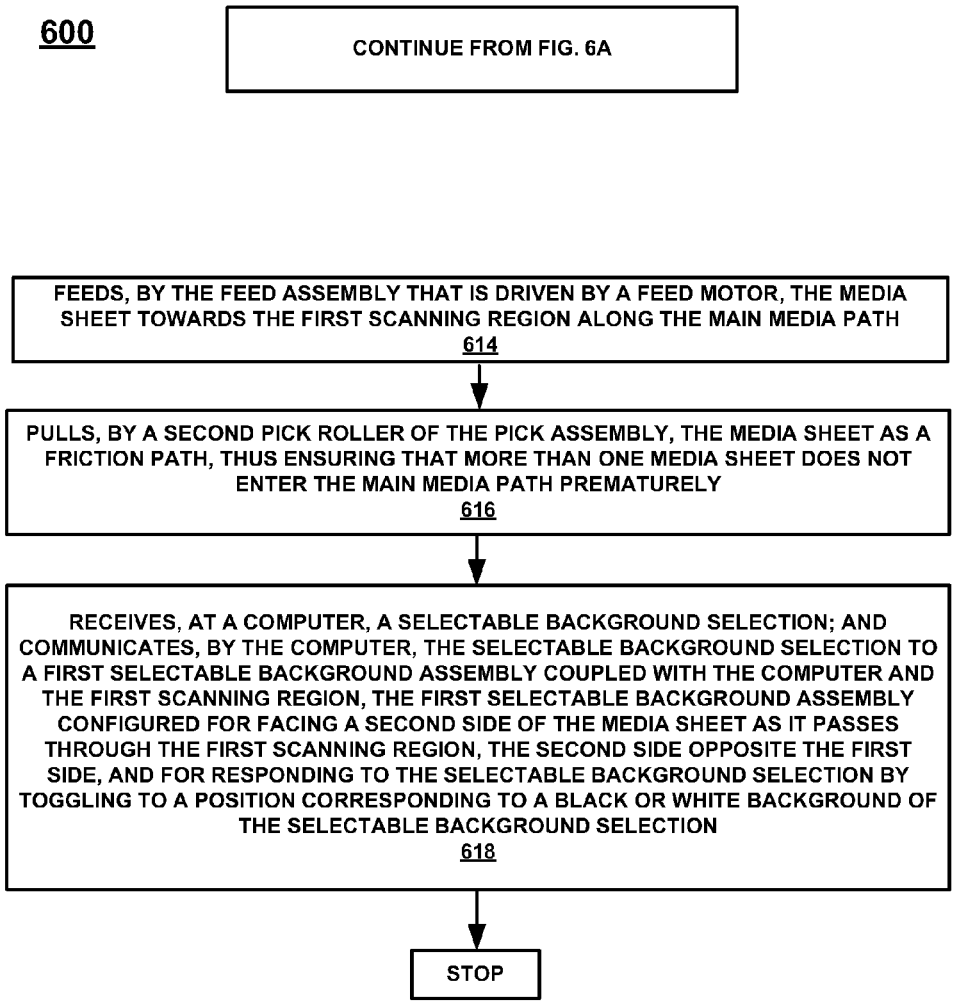
FIG. 6B is continuation of FIG. 6A, a flow diagram of a method for feeding a media sheet through an automatic document feeding device, according to an embodiment of the present technology.

Referring now to FIGS. 6A and 6B, a flow diagram of a method 600 for feeding a media sheet through an ADF device 300 is shown, according to an embodiment of the present technology. In one embodiment, steps 604, 606 and 620 described below at least partially are embodied in instructions, stored on a non-transitory computer readable storage medium, which when executed by a computer 500 system (see 700 of FIG. 7), cause the computer 500 system to perform the method steps of 604, 606 and 618 (described below). The method 600 is described below with reference to FIGS. 1-6B.

Significantly and as will be explained below, embodiments of the present technology enable the operation of an ADF utilizing a three pass single scanner system and a single pass two sided scan system.

At 602 of FIG. 6A and also referring to FIGS. 3 and 4A-4C, in one embodiment and as already described herein, a first pick roller 12*a* of a pick assembly 12 picks a media sheet from a media stack one by one and feeds the media sheet into a main media path $P_1$. The pick assembly 12 is driven by a pick motor 305 and the main media path $P_1$ guides the media sheet from the pick assembly to a first scanning region 19 and from the first scanning region 19 to an output tray 17. The first scanning region 19 includes a first scanner 405 positioned for scanning an image of a first side of the media sheet as it passes through the first scanning region 19. Further, in one embodiment and as already described herein, the pick assembly 12, the deskew assembly and the feed assembly 425 operate independently of each other.

At 604 of FIG. 6A and also referring to FIGS. 3 and 4A-4C, in one embodiment and as already described herein, a presence of a media sheet is sensed at a predetermined position along the main media path $P_1$. In one embodiment, a sensor assembly 320 senses the media sheet's presence. It should be appreciated that the predetermined position may be a variety of different positions. For example, but not limited to, the predetermined position may be the point at which the leading edge of the media sheet lies against the at least one pair of opposing deskew rollers 13. However, in another example, the predetermined position may be a position in which the leading edge of the media sheet is a millimeter away from the at least one pair of opposing deskew rollers 13.

For example, and referring to 606 of FIG. 6A and also to FIGS. 3 and 4A-4C, in one embodiment and as already described herein, a computer 500 senses 604 the presence of the media sheet at a predetermined position at which a leading edge of the media sheet comes into contact with at least one pair of opposing stationary deskew rollers 13 of the deskew assembly such that the media sheet is fed far enough towards the at least one pair of opposing stationary deskew rollers 13 to create a buckle on the media sheet. Thus, the leading edge of the media sheet is ensured to be squared evenly into the at least one pair of opposing stationary deskew rollers 13 before the deskew motor 310 is activated.

At 608 of FIG. 6A and also referring to FIGS. 3 and 4A-4C, in one embodiment and as already described herein, in response to the sensing of 604, a deskew motor 310 is activated by the computer 500. The deskew motor 310 drives a deskew assembly.

At 609 of FIG. 6A and also referring to FIGS. 3 and 4A-4C, in one embodiment and as already described herein as the "pick and park" feature, in response to the sensing of 604, a pick motor 305 is activated by the computer 500. The pick motor 305 drives the pick assembly 12 such that said media sheet is picked and moved into a waiting position along the main media path $P_2$, wherein the media sheet remains is the waiting position until the deskew motor 315 is activated by the computer 500.

At 610 of FIG. 6A and also referring to FIGS. 3 and 4A-4C, in one embodiment and as already described herein, the deskew assembly deskews the media sheet. More particularly, in one embodiment, by deskewing, the deskew assembly squares the leading edge of the media sheet. In one embodiment, and as already described herein, the picking of 602 and the deskewing on 610 occur at speeds less than a speed of the feeding of 614.

At 612 of FIG. 6A and also referring to FIGS. 3 and 4A-4C, in one embodiment and as already described herein, the media sheet is moved from the pick assembly 12 to a feed assembly 425, wherein the deskew assembly moves independently of the pick assembly 12 and the feed assembly 425.

At 614 of FIG. 6A and also referring to FIGS. 3 and 4A-4C, in one embodiment and as already described herein, the media sheet is fed by the feed assembly 425, which is driven by a feed motor 315, towards the first scanning region 19 along the main media path $P_1$. In one embodiment, and as already described herein, the feeding of 614 includes advancing the media sheet in a forward direction toward the output tray 17 while the first side of the media sheet is scanned during a first pass of the first scanner 405. The advancing is performed by the at least one pair of opposing pre-scan rollers 14, the at least one pair of opposing post-scan rollers 15 and the at least one pair of opposing output rollers 16. The at least one pair of opposing pre-scan rollers 14 are positioned along the main media path $P_1$ after the deskew assembly and before the first scanning region 19. The at least one pair of opposing post-scan rollers 15 are positioned along the main media path $P_1$ after the first scanning region 19. The at least one pair of opposing output rollers 16 are positioned along the main media path $P_1$ after the at least one pair of opposing post-scan rollers 15 and before the output tray 17.

Further, in one embodiment and as already described herein, the media sheet is then received along the switch-back path $P_2$, while the at least one pair of opposing output rollers 16 operate in reverse. The switch-back path $P_2$ extends from the at least one pair of opposing output rollers 16 toward the deskew assembly.

Additionally, in one embodiment and as already described herein, the media sheet is advanced towards the first scanning region 19 after the media sheet moves from the switch-back path $P_2$ into the main media path $P_1$ such that a second side of the media sheet is scanned in a second pass through the first scanning region 19. Moreover, in one embodiment and as already described herein, after the second side of the media sheet is scanned in the second pass, the media sheet is advanced in a forward direction toward the at least one pair of opposing output rollers 16. Whereupon, once arriving at the at least one pair of opposing output rollers 16, the media sheet is advanced towards the switch-back path $P_2$ for a third pass along the main media path $P_1$, wherein the at least one pair of opposing output rollers 16 are operating in reverse. The third pass turns the media sheet around, thus enabling the media sheet to arrive at the output tray 17 in a same order as that order input form the media stack into the main media path $P_1$.

It should be appreciated that the activation signal sent by the computer 500 to a motor to drive the opening and the closing of the at least one pair of output rollers 16 is dependent upon at least, but not limited to, the length of the media sheet itself as it passes through the feed assembly 425 rollers, the stage within the operation of the ADF 300 (e.g., the first, second or third pass) and the location of the media sheet as determined by the pre-scan sensor 425. For example, during the second and third pass of the media sheet along the main media path $P_1$, in one embodiment, the deskew motor 310 drives the at least one pair of opposing output rollers 16 to open and close (nipping) such that the leading and trailing edge of the media sheet may cross each other.

In another example, if the length of a media sheet moving along the main media path P1 is more than 11 inches, then the at least one pair of opposing output rollers 16 open up. However, if the length of the media sheet is less than 11 inches, then the at least one pair of opposing output rollers 16 do not open. In one embodiment, such as during the second pass, after the at least one pair of opposing output rollers 16 close, the rollers of the feed assembly 425 moves in the forward direction (moving the media sheet along the main media path $P_1$ towards the output tray 17) and then moves in the reverse direction (moving the media sheet along the switch-back path $P_2$ towards the deskew assembly), per the instructions from the computer 500. In another embodiment, such as at the end of the third pass, after the at least one pair of opposing output rollers 16 close, the rollers of the fee assembly 425 continue to move in the forward direction (moving the media sheet along the main media path $P_1$ towards the output tray 17). It should be appreciated that while in one embodiment, the deskew motor 310 drives the nipping of the at least one pair of opposing output rollers 16, in another embodiment, another motor (e.g., pick motor 305) drives the nipping of the at least one pair of opposing output rollers 16.

In another embodiment and as described herein, the feeding of 614 includes advancing the media sheet in a forward direction through the first scanning region 19 and towards a second scanner 450 of a second scanning region 455. The second scanning region 455 is positioned between opposing post-scan rollers 15 and opposing output rollers 16. The second scanner 450 is positioned for scanning an image of a second side of the media sheet such that the first and second sides of the media sheet are scanned in a single pass through the first and second scanning regions, 9 and 455, respectively, before the media sheet is output to the output tray 17. In one embodiment, the advancing is performed by at least one pair of opposing pre-scan rollers 14, at least one pair of opposing post-scan rollers 15. The at least one pair of opposing pre-scan rollers 14 are positioned along the main media path $P_1$ after the deskew assembly and before the first scanning region 19. The at least one pair of opposing post-scan rollers 15 are positioned along the main media path $P_1$ after the first scanning region 19. The at least one pair of opposing output rollers 16 are positioned along the main media path $P_1$ after the at least one pair of opposing post-scan rollers 15 and before the output tray 17.

At 616 of FIG. 6B and also referring to FIGS. 3 and 4A-4C, in one embodiment, the media sheet is pulled by a second pick roller (e.g. 12*b*) as a friction path, thus ensuring that more than one media sheet does not enter the main media path $P_1$ prematurely.

At 618 of FIG. 6B and also referring to FIGS. 3, 4A-4C and 5, in one embodiment and as already described herein, a selectable background selection is received at a computer (e.g. computer 500). The selectable background selection is communicated by the computer to a first selectable background assembly 525 that is coupled with the computer and the first scanning region 19. The first selectable background assembly 525 faces a second side of the media sheet as it passes through the first scanning region 19. The second side is opposite the first side of the media sheet. The selectable background assembly 525 also responds to the selectable background selection by toggling to a position corresponding to a black or white background of the selectable background selection.

In one embodiment, the picking 602 and deskewing 610 occur at speeds less than a speed of the feeding 614.

Embodiments of the present technology, with some simple modifications of the base ADF, work with both three pass single scanner systems and single pass two sided scan systems. The three pass single scanner system is one in which there is just a single scanner. The media sheet must move in a first direction to allow the single scanner to scan one side of the media sheet. The media sheet is fed through a switch-back path $P_2$ such that the media sheet is turned around. Then, the media sheet makes a second pass through the scanning region 19, allowing the other side of the media sheet to be scanned. The media sheet must then make a third pass (to turn the media sheet around again) through the switch-back path P2, the at least one pair of opposing deskew, pre-scan and post-scan rollers, 13, 14 and 15, respectively, before the media sheet is guided to the output tray 17 by the feed assembly 425.

The single pass two sided scan system, on the other hand, includes two scanners, one within the first scanning region 19 and one within the second scanning region 455, one on either side of the passing media sheet. Thus, the media sheet only passes through each of the first and second scanning regions, 19 and 455, respectively, once, and remains moving in one direction along the main media path $P_1$.

Thus, embodiments of the present technology enable more throughput through an ADF by providing a system including independent motors operating at different speeds, thereby reducing the inter-page gap during the scanning process. Further, embodiments of the present technology enable the better identification of the edges of the media sheets and the switching of black and white selectable backgrounds, thereby facilitating a better quality copy. Moreover, embodiments of the present technology work with both a three pass single scanner system and a single pass two sided scan system, thereby providing quality choices for consumers.

Example Computer System Environment

Figure 7:
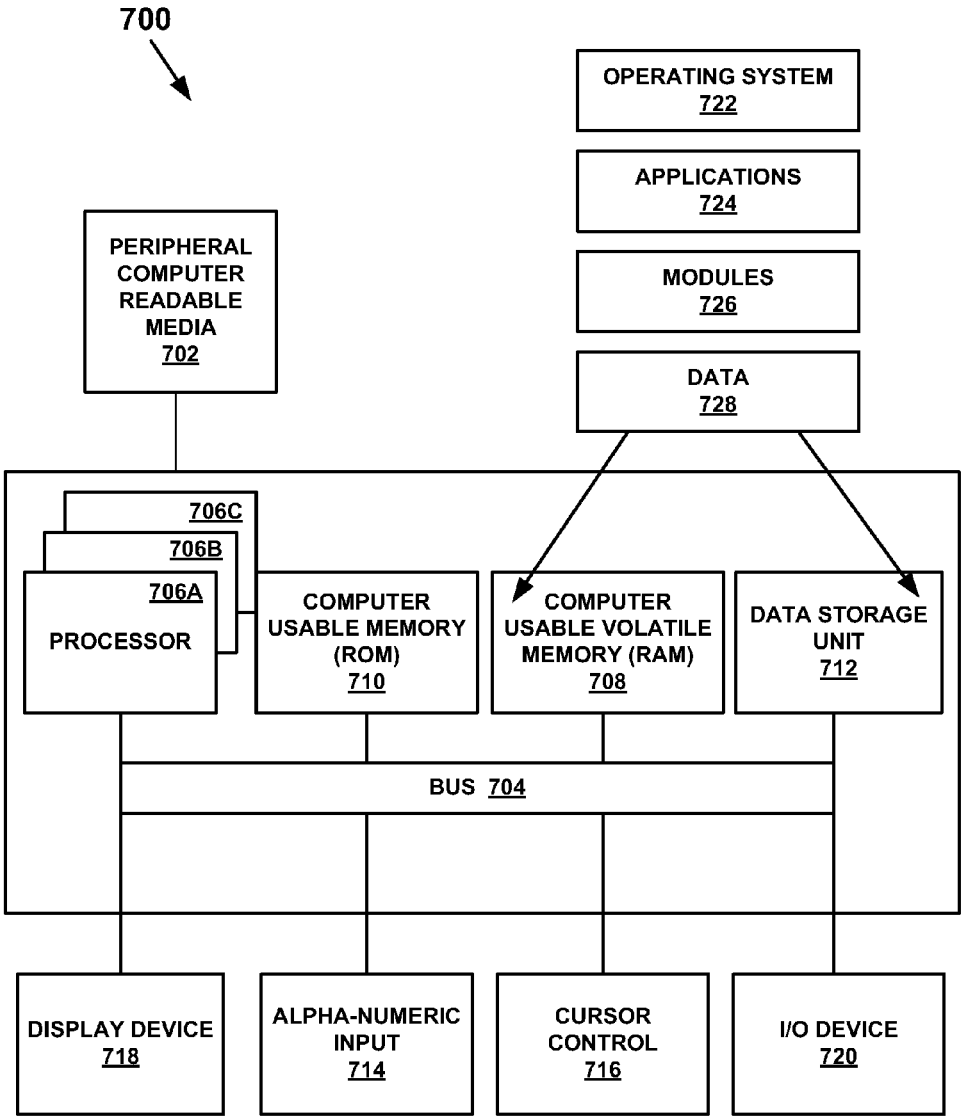
FIG. 7 is a diagram of an example computer system used for the method of feeding a media sheet through an automatic document feeding device, according to an embodiment of the present technology.

With reference now to FIG. 7, portions of the technology for: the sensing of 604, the activating of 608, and the receiving and communicating of 618 are composed of computer-readable and computer-executable instructions that reside, for example, in computer-readable storage media of a computer system. That is, FIG. 7 illustrates one example of a type of computer that can be used to implement embodiments, which are discussed below, of the present technology.

FIG. 7 illustrates an example computer system 700 used in accordance with embodiments of the present technology. In one embodiment, computer system 700 is the same as the computer 500 shown in FIGS. 4A and 5. It is appreciated that system 700 of FIG. 7 is an example only and that the present technology can operate on or within a number of different computer systems including general purpose networked computer systems, embedded computer systems, routers, switches, server devices, user devices, various intermediate devices/artifacts, stand alone computer systems, and the like. As shown in FIG. 7, computer system 700 of FIG. 7 is well adapted to having peripheral computer readable media 702 such as, for example, a floppy disk, a compact disc, and the like coupled thereto.

System 700 of FIG. 7 includes an address/data bus 704 for communicating information, and a processor 706A coupled to bus 704 for processing information and instructions. As depicted in FIG. 7, system 700 is also well suited to a multi-processor environment in which a plurality of processors 706A, 706B, and 706C are present. Conversely, system 700 is also well suited to having a single processor such as, for example, processor 706A. Processors 706A, 706B, and 706C may be any of various types of microprocessors. System 700 also includes data storage features such as a computer usable volatile memory 708, e.g. random access memory (RAM), coupled to bus 704 for storing information and instructions for processors 706A, 706B, and 706C.

System 700 also includes computer usable non-volatile memory 710, e.g. read only memory (ROM), coupled to bus 704 for storing static information and instructions for processors 706A, 7068, and 706C. Also present in system 700 is a data storage unit 712 (e.g., a magnetic or optical disk and disk drive) coupled to bus 704 for storing information and instructions. System 700 also includes an optional alphanumeric input device 714 including alphanumeric and function keys coupled to bus 704 for communicating information and command selections to processor 706A or processors 706A, 706B, and 706C. System 700 also includes an optional cursor control device 716 coupled to bus 704 for communicating user input information and command selections to processor 706A or processors 706A, 706B, and 706C. System 700 of the present embodiment also includes an optional display device 718 coupled to bus 704 for displaying information.

Referring still to FIG. 7, optional display device 718 of FIG. 7 may be a liquid crystal device, cathode ray tube, plasma display device or other display device suitable for creating graphic images and alphanumeric characters recognizable to a user. Optional cursor control device 716 allows the computer user to dynamically signal the movement of a visible symbol (cursor) on a display screen of display device 718. Many implementations of cursor control device 716 are known in the art including a trackball, mouse, touch pad, joystick or special keys on alpha-numeric input device 714 capable of signaling movement of a given direction or manner of displacement. Alternatively, it will be appreciated that a cursor can be directed and/or activated via input from alpha-numeric input device 714 using special keys and key sequence commands.

System 700 is also well suited to having a cursor directed by other means such as, for example, voice commands. System 700 also includes an I/O device 720 for coupling system 700 with external entities. For example, in one embodiment, I/O device 720 is a modem for enabling wired or wireless communications between system 700 and an external network such as, but not limited to, the Internet. A more detailed discussion of the present technology is found below.

Referring still to FIG. 7, various other components are depicted for system 700. Specifically, when present, an operating system 722, applications 724, modules 726, and data 728 are shown as typically residing in one or some combination of computer usable volatile memory 708, e.g. random access memory (RAM), and data storage unit 712. However, it is appreciated that in some embodiments, operating system 722 may be stored in other locations such as on a network or on a flash drive; and that further, operating system 722 may be accessed from a remote location via, for example, a coupling to the internet. In one embodiment, the present technology, for example, is stored as an application 724 or module 726 in memory locations within RAM 708 and memory areas within data storage unit 712. The present technology may be applied to one or more elements of described system 700. For example, a method for identifying a device associated with a transfer of content may be applied to operating system 722, applications 724, modules 726, and/or data 728.

The computing system 700 is only one example of a suitable computing environment and is not intended to suggest any limitation as to the scope of use or functionality of the present technology. Neither should the computing environment 700 be interpreted as having any dependency or requirement relating to any one or combination of components illustrated in the example computing system 700.

The present technology may be described in the general context of computer-executable instructions, such as program modules, being executed by a computer. Generally, program modules include routines, programs, objects, components, data structures, etc., that perform particular tasks or implement particular abstract data types. The present technology may also be practiced in distributed computing environments where tasks are performed by remote processing devices that are linked through a communications network. In a distributed computing environment, program modules may be located in both local and remote computer-storage media including memory-storage devices.

All statements herein reciting principles, aspects, and embodiments of the invention as well as specific examples thereof, are intended to encompass both structural and functional equivalents thereof. Additionally, it is intended that such equivalents include both currently known equivalents and equivalents developed in the future, i.e., any elements developed that perform the same function, regardless of structure. The scope of the present invention, therefore, is not intended to be limited to the exemplary embodiments shown and described herein. Rather, the scope and spirit of present invention is embodied by the appended claims.

What is claimed is:

1. An automatic document feeding device comprising:

a pick motor coupled with a pick assembly, said pick motor configured for driving said pick assembly, said pick assembly configured for pulling a media sheet from a beginning media stack one by one and feeding said media sheet into a main media path, said main media path configured for guiding said media sheet from said pick assembly to a first scanning region and from said first scanning region to an output tray, wherein said first scanning region comprises a first scanner positioned for scanning an image of a first side of said media sheet as it passes through said first scanning region, and wherein said pick motor is a direct current (DC) servo motor;

a deskew motor coupled with a deskew assembly, said deskew motor configured for driving said deskew assembly, said deskew assembly configured for deskewing said media sheet and moving said media sheet from said pick assembly to a feed assembly, said deskew assembly moving independently of said pick assembly and said feed assembly, and wherein said deskew motor is a DC servo motor;

a feed motor coupled with said feed assembly, said feed motor configured for driving said feed assembly, said feed assembly configured for feeding said media sheet towards said output tray from said deskew assembly along said main media path, and wherein said feed is a DC servo motor; and a sensor assembly coupled with said main media path and a computer, said sensor assembly comprising a plurality of sensors, each sensor of said sensor assembly coupled with at least one of said pick assembly, said deskew assembly, said feed assembly and said first scanner, said sensor assembly configured for sensing said media sheet moving along said main media path and based on said sensing, sending at least one signal to said computer, wherein based on said at least one signal, said computer sends an activation signal to at least one of said pick motor, said deskew motor, said feed motor and said first scanner.

2. The automatic document feeding device of claim 1, wherein said feed assembly comprises:

at east one pair of opposing pre-scan rollers positioned along said main media path after said deskew assembly and before said first scanning region;

at least one pair of opposing post-scan rollers positioned along said main media path after said first scanning region, at least one pair of opposing output rollers positioned along said main media path after said at least one pair of opposing post-scan rollers and before said output tray, wherein said at least one pair of opposing pre-scan, post-scan and output rollers are configured for advancing said media sheet in a forward direction toward said output tray while said first side of said media sheet is scanned during a first pass of said first scanner, and a switch-back path extending from said at least one pair of opposing output rollers toward said deskew assembly, said switch-back path configured to receive said media sheet driven in reverse by said at least one pair of opposing output rollers such that said media sheet is then turned around, thereby enabling said second side of said media sheet to be scanned in a second pass through said first scanning region moving in a reverse direction towards said at least one pair of opposing pre-scan rollers, whereupon after said second pass and having moved through said at least one pair of opposing post-scan rollers, said media sheet is once again advanced in a forward direction by said at least one pair of opposing output rollers toward said switch-back path for a third pass along said main media path, wherein during said third pass said media sheet is turned around, thereby enabling said media sheet to arrive at a finished media stack in said output tray in a same order as said media sheet having been picked by said pick assembly, and wherein during said third pass, said media sheet is moved along said main media path at a speed different than a speed at which said media sheet is moved along said main media path during said first and second passes.

3. The automatic document feeding device of claim 2, wherein said deskew assembly is configured for squaring a leading edge of said media sheet to arrive at a squared media sheet, and delivering said squared media sheet to said at least one pair of opposing pre-scan rollers.

4. The automatic document feeding device of claim 3, further comprising:

a second selectable background assembly coupled with said computer, said second selectable background assembly configured for facing said first side of said media sheet as it passes through said second scanning region, said second selectable background assembly configured for responding to said selectable background selection, said responding comprising:

achieving a calibration position, said calibration position activated on-demand; and toggling to a position corresponding to a black or white background of said selectable background selection.

5. The automatic document feeding device of claim 1, further comprising:

a second scanner positioned between said at least one pair of opposing post-scan rollers and said at least one pair of opposing output rollers and coupled with a second scanning region, said second scanner configured for scanning an image of a second side of said media sheet such that said first and second sides of said media sheet are scanned in a single pass through said first and second scanning regions before said media sheet is output to said output tray.

6. The automatic document feeding device of claim 1, further comprising:

background selection receiver coupled with said computer, said background selection receiver configured for receiving a selectable background selection;

a background selection communication module coupled with said computer, said background selection communication module configured for communicating a selectable background selection;

a first selectable background assembly coupled with said computer, said first selectable background assembly configured for facing a second side of said media sheet as it passes through said first scanning region, said second side opposite said first side, said first selectable background assembly configured for responding to said selectable background selection by toggling to a position corresponding to a black or white background of said selectable background selection.

7. A method for feeding a media sheet through an automatic document feeding device, said method comprising:

picking, by a first pick roper of a pick assembly, a media sheet from a media stack one by one and feeding said media sheet into a main media path, said pick assembly being driven by a pick motor, said main media path configured for guiding said media sheet from said pick assembly to a first scanning region and from said first scanning region to an output tray, wherein said first scanning region comprises a first scanner positioned for scanning an image of a first side of said media sheet as it passes through said first scanning region, and wherein said pick motor is a direct current (DC) servo motor;

sensing by a sensor assembly a presence of a media sheet at a predetermined position along said main media path, said sensor assembly coupled with said main media path and comprising a plurality of sensors, each sensor of said plurality of sensors coupled with at least one of said pick assembly, a deskew assembly, a feed assembly and said first scanner, said sensor assembly being coupled with a computer;

in response to said sensing, activating, by said computer, a deskew motor that is configured for driving said deskew assembly;

deskewing said media sheet by said deskew assembly;

moving said media sheet from said pick assembly to said feed assembly, said deskew assembly moving independently of said pick assembly and said feed assembly;

feeding, by said feed assembly that is driven by a feed motor, said media sheet towards said first scanning region along said main media path.

8. The method of claim 7, further comprising:

in response to said sensing, activating, by said computer, said pick motor to drive said pick assembly such that said media sheet is picked and moved into a waiting position along said main media path, wherein said media sheet remains is said waiting position until said deskew motor is activated by said computer.

9. The method of claim 7, further comprising:

pulling, by a second pick roller of said pick assembly, said media sheet as a friction path, thus ensuring that more than one media sheet does not enter said main media path prematurely.

10. The method of claim 7, further comprising:

receiving, at a computer, a selectable background selection;

communicating, by said computer, said selectable background selection to a first selectable background assembly coupled with said computer and said first scanning region, said first selectable background assembly configured for facing a second side of said media sheet as it passes through said first scanning region, said second side opposite said first side, and for responding to said selectable background selection by toggling to a position corresponding to a black or white background of said selectable background selection.

11. The method of claim 7, wherein said feeding comprises:

advancing said media sheet in a forward direction toward said output tray while said first side of said media sheet is scanned during a first pass of said first scanner, said advancing performed by at least one pair of opposing pre-scan rollers, at least one pair of opposing post-scan rollers and at least one pair of opposing output rollers, said at least one pair of opposing pre-scan rollers positioned along said main media path after said deskew assembly and before said first scanning region, said at least one pair of opposing post-scan rollers positioned along said main media path after said first scanning region, and at least one pair of opposing output rollers positioned along said main media path after said at least one pair of opposing post-scan rollers and before said output tray.

12. The method of claim 11, further comprising:

receiving, along a switch-back path, said media sheet in reverse, wherein said switch-back path extends from said at least one pair of opposing output rollers toward said deskew assembly, and wherein said at least one pair of opposing output rollers are operating in reverse;

advancing towards said first scanning region said media sheet after it moves from said switch-back path into said main media path such that a second side of said media sheet is scanned in a second pass through said first scanning region.

13. The method of claim 12, further comprising:

after said second side of said media sheet is scanned in said second pass, advancing said media sheet in a forward direction toward said at least one pair of opposing output rollers;

whereupon once arriving at said at least one pair of opposing output rollers, advancing said media sheet towards said switch-back path for a third pass along said main media path by operating said at least one pair of opposing output rollers in reverse, wherein said third pass turns said media sheet around, enabling said media sheet to arrive at said output tray in a same order as that order input from said media stack into said main media path, and wherein during said third pass, said media sheet is moved along said main media path at a speed different than a speed at which said media sheet is moved along said main media path during said first and second passes.

14. The method of claim 7, wherein said feeding comprises:

advancing said media sheet in a forward direction through said first scanning region and towards a second scanner of a second scanning region, said second scanning region positioned between opposing post-scan rollers and opposing output rollers, said second scanner positioned for scanning an image of a second side of said media sheet such that said first and second sides of said media sheet are scanned in a single pass through said first and second scanning regions before said media sheet is output to said output tray;

said advancing performed by at least one pair of opposing pre-scan rollers, at least one pair of said opposing post-scan rollers and at least one pair of said opposing output rollers, said at least one pair of opposing pre-scan rollers positioned along said main media path after said deskew assembly and before said first scanning region, said at least one pair of opposing post-scan rollers positioned along said main media path after said first scanning region, and at least one pair of opposing output rollers positioned along said main media path after said at least one pair of opposing post-scan rollers and before said output tray.

15. The method of claim 7, wherein said sensing a presence, by a computer, of said media sheet at a predetermined position comprises:

sensing a presence of said media sheet at a predetermined position at which a leading edge of said media sheet comes into contact with a stationary deskew roller of said deskew assembly such that said media sheet is fed far enough towards said deskew roller to create a buckle on said media sheet, thereby ensuring that said leading edge of said media sheet is squared evenly into said stationary deskew roller before said deskew motor is activated.

16. The method of claim 7, wherein said deskewing comprises:

Squaring, by said deskew assembly, a leading edge of said media sheet to arrive at a squared media sheet; and delivering said squared media sheet to said at least one pair of opposing pre-scan rollers.

17. The method of claim 7, wherein said pick assembly, said deskew assembly and said feed assembly operate independently of each other.

18. The method of claim 11, wherein said advancing comprises:

nipping by said at least one pair of opposing output rollers, wherein, while performing said nipping, said at least one pair of opposing output rollers are driven by said deskew motor.

19. The method of claim 13, wherein said deskewing comprises:

squaring, by said deskew assembly, a leading edge of said media sheet to arrive at a squared media sheet; and delivering said squared media sheet to said at least one pair of opposing pre-scan rollers;

during said third pass, delivering said squared media sheet to said at least one pair of opposing pre-scan rollers without performing a re-squaring of said leading edge of said media sheet.

20. A method for feeding a media sheet through an automatic document feeding device, said method comprising:

picking, by a first pick roller of a pick assembly, a media sheet from a media stack one by one and feeding said media sheet into a main media path, said pick assembly being driven by a pick motor, said main media path configured for guiding said media sheet from said pick assembly to a first scanning region and from said first scanning region to an output tray, wherein said first scanning region comprises a first scanner positioned for scanning an image of a first side of said media sheet as it passes through said first scanning region;

sensing by a sensor assembly a presence of a media sheet at a predetermined position along said main media path, said sensor assembly coupled with said main media path and comprising a plurality of sensors, each sensor of said plurality of sensors coupled with at least one of said pick assembly, a deskew assembly, a feed assembly and said first scanner, said sensor assembly being coupled with a computer;

in response to said sensing, activating, by said computer, a deskew motor that is configured for driving said deskew assembly, wherein said deskew motor is a direct current (DC) servo motor;

deskewing said media sheet by said deskew assembly;

moving said media sheet from said pick assembly to said feed assembly, said deskew assembly moving independently of said pick assembly and said feed assembly;

feeding, by said feed assembly that is driven by a feed motor, said media sheet towards said first scanning region along said main media path.

* * * * *

UNITED STATES PATENT AND TRADEMARK OFFICE

CERTIFICATE OF CORRECTION

PATENT NO. : 8,613,440 B2
APPLICATION NO. : 13/179995
DATED : December 24, 2013
INVENTOR(S) : Long C Doan et al.

It is certified that error appears in the above-identified patent and that said Letters Patent is hereby corrected as shown below:

In the Claims

Column 20, line 27, in Claim 1, after "feed" insert -- motor --.

Column 20, line 43, in Claim 2, delete "east" and insert -- least --, therefor.

Column 21, line 62, in Claim 7, delete "roper" and insert -- roller --, therefor.

Column 22, line 30, in Claim 8, delete "is" and insert -- in --, therefor.

Column 24, line 6, in Claim 16, delete "Squaring," and insert -- squaring, --, therefor.

Signed and Sealed this
Sixth Day of May, 2014

Michelle K. Lee

Michelle K. Lee
*Deputy Director of the United States Patent and Trademark Office*